United States Patent [19]

Leonhart

[11] 4,319,779

[45] Mar. 16, 1982

[54] ADJUSTABLE LAWN CHAIR WITH SEPARATE FOOTREST

[76] Inventor: Xaver F. Leonhart, 8385 Harburg, near 8385 Pilsting, Fed. Rep. of Germany

[21] Appl. No.: 158,625

[22] Filed: Jun. 11, 1980

[30] Foreign Application Priority Data

Jun. 12, 1979 [DE] Fed. Rep. of Germany ..... 29237250

[51] Int. Cl.[3] ..... A47C 4/04

[52] U.S. Cl. ..... 297/19; 297/28; 297/118; 297/56

[58] Field of Search ..... 297/16, 19, 24, 27, 297/28, 56, 118

[56] References Cited

U.S. PATENT DOCUMENTS

| | | | |
|---|---|---|---|
| 155,758 | 10/1874 | Schlientz | 297/28 |
| 483,810 | 10/1892 | Nesmith | 297/56 |
| 2,318,067 | 5/1943 | Ebbert | 297/118 |
| 2,675,059 | 4/1954 | Martin | 297/28 X |

FOREIGN PATENT DOCUMENTS

| | | | |
|---|---|---|---|
| 359695 | 7/1938 | Italy | 297/28 |
| 311006 | 5/1929 | United Kingdom | 297/118 |

*Primary Examiner*—Francis K. Zugel

*Attorney, Agent, or Firm*—Brady, O'Boyle & Gates

[57] ABSTRACT

A relatively straight back curves forward at the lower end at a small angle to the longitudinal axis of the back to form an integral supporting foot portion, and at the approximate center of the length of each side member of the back a pivot journal or stud projects inwardly to selectively engage in detents in the lower edge of an armrest when used as a chair. The armrest is pivoted adjacent the opposite end to the top portion of a pivotable foot which is pivoted to the supporting foot portion to form an adjustable cross therewith. The pivot journal engages the armrest lower edge adjacent the pivot connection with pivotable foot when used as a chaise lounge. A seat is pivoted at one end to the side member in proximity to the pivot journal and is supported in a chair position by a removable crossbar engaging the underside thereof and recesses in strips connected on the inside of the pivotable foot. Stop pins project from the strips and in the chaise lounge position engage the forward edge of the supporting foot portion, in which position a recess beneath the seat engages a stationary cross strut on the pivotable foot or a removable crossbar across the forward edges of the supporting foot portion for two adjusted positions of the reclining seat surface.

4 Claims, 6 Drawing Figures

54
16
44
17
18
15
10
9
14
4
13
1
2
20
8
12
35
22
38
27
37
30
41
24
43
40
6
33
32
26
42
28
39

54
17
16
18
4
10
2
9
44
15
1
14
13
20
8
12
22
35
41
27
30
37
24
26
40
43
39
32
33
28
44
6
38
42

ADJUSTABLE LAWN CHAIR WITH SEPARATE FOOTREST

BACKGROUND OF THE INVENTION

The invention relates to an adjustable lawn chair with separate footrest, distinguished by its great versatility regarding the usage possibilities.

The conventional lawn chairs heretofore have not been usable as chaise lounges. Special constructions are provided for that purpose which, in turn, cannot be employed as lawn chairs.

The invention is based on the object of constructing an adjustable lawn chair having a separate footrest so that it permits, as a lawn chair, varying inclinations of the back, but can simultaneously be utilized as a chaise lounge, with the inclusion of the separate footrest, wherein the head portion and the foot portion can be inclined or lifted to varying degrees to maintain special positions of the body, even for therapeutic purposes.

SUMMARY OF THE INVENTION

To attain this object, an adjustable lawn chair having a separate footrest is utilized, with a back adjoined by a supporting foot under a small angle, with a pivotable foot forming an adjustable cross with the supporting foot, and with an armrest articulated to the pivotable foot.

The adjustable lawn chair with separate footrest according to the invention is characterized by a back, the side members of which exhibit in the center respectively one outwardly projecting pivot journal and to the insides thereof, in the proximity of the pivot journal one end of a seat is freely movably articulated, this seat exhibiting on the underside of each frame member at least one recess; by a pivotable foot having a fixed strip on the inside equipped at the ends with recesses for the insertion of a special crossbar and exhibiting an inwardly oriented stop pin; as well as by an armrest having detents milled in to one-half its depth for the insertion of the pivot journal and having two fixed cross struts at the free ends.

To fully exploit the adjusting possibilities of a chair according to the invention, it is recommended to provide two crossbars which, during non-use, are kept in readiness in the bore at the upper end of the back and in the bore at the rear end of the armrest, wherein one crossbar advantageously serves for suspending a removable pad for the back and seat.

To give the crossbars a secure hold at the linkage of the chair, it is advantageous to have the ends of the crossbars serve for the guidance of round bars, which latter are urged outwardly by means of a weak spring until they abut at a stop, and to provide, on the one hand, caps at the freely projecting ends of the bars, these caps fitting with a minor amount of play in the bores of the back, and, on the other hand, two flanges at each end, so that it is conveniently possible to remove the bars merely by placing the fingers between the flanges and by moving the arms together.

If the armrests are additionally equipped with a series of large bores in the longitudinal direction, the result is not only a more comprehensive adjusting possibility for the back, but also the additional opportunity is offered of protecting children from falling out of the chair.

BRIEF DESCRIPTION OF THE DRAWINGS

The drawings represent an adjustable lawn chair with separate footrest according to the invention by way of example, to wit.

DESCRIPTION OF THE PREFERRED EMBODIMENT

Figures 1, 2:
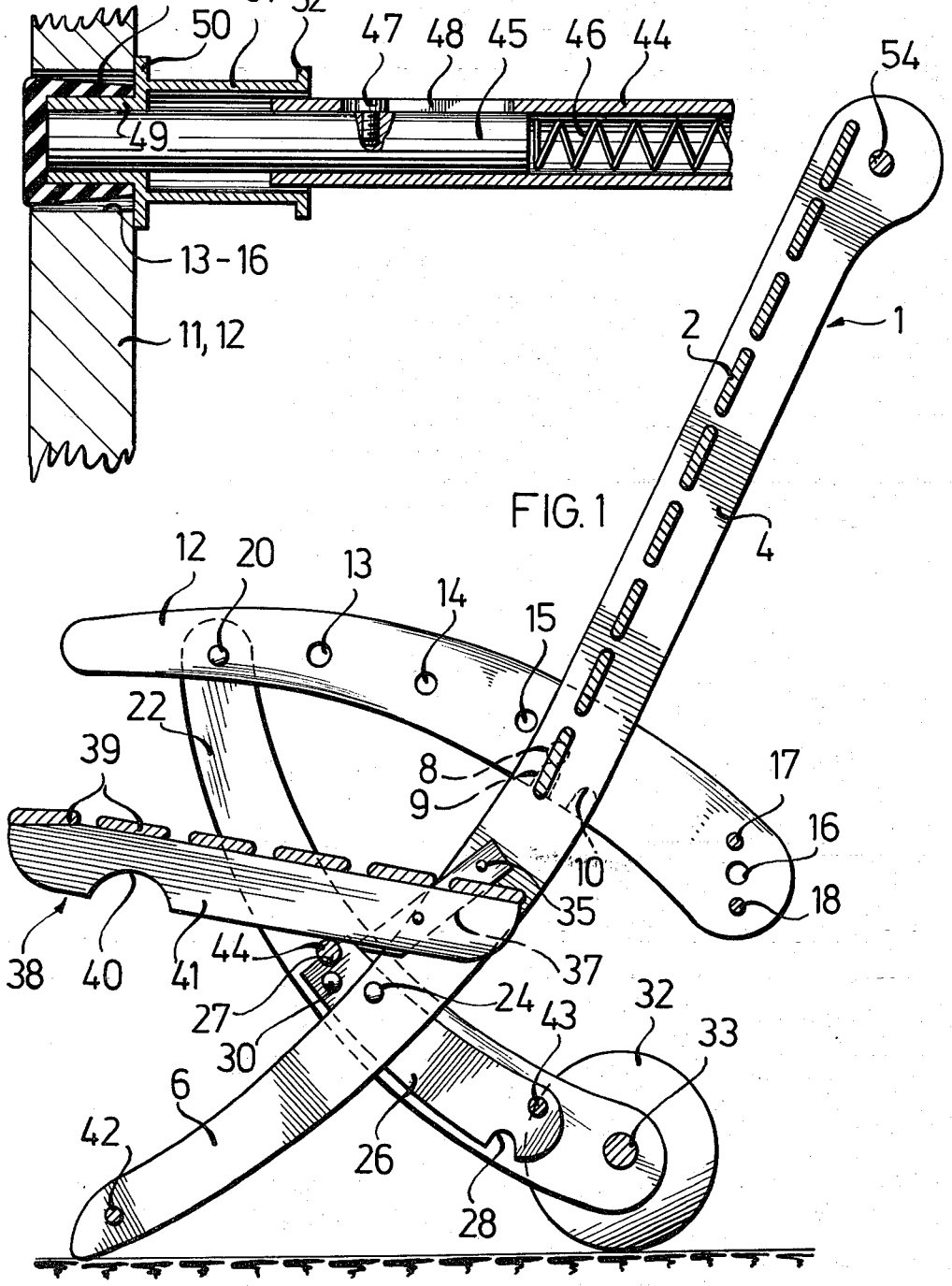
FIG. 1 shows a lawn chair according to the invention in the position of an armchair.
FIG. 2 shows one end of a special crossbar to attain the various adjusting possibilities of the chair, in a longitudinal sectional view.
Figure 4:
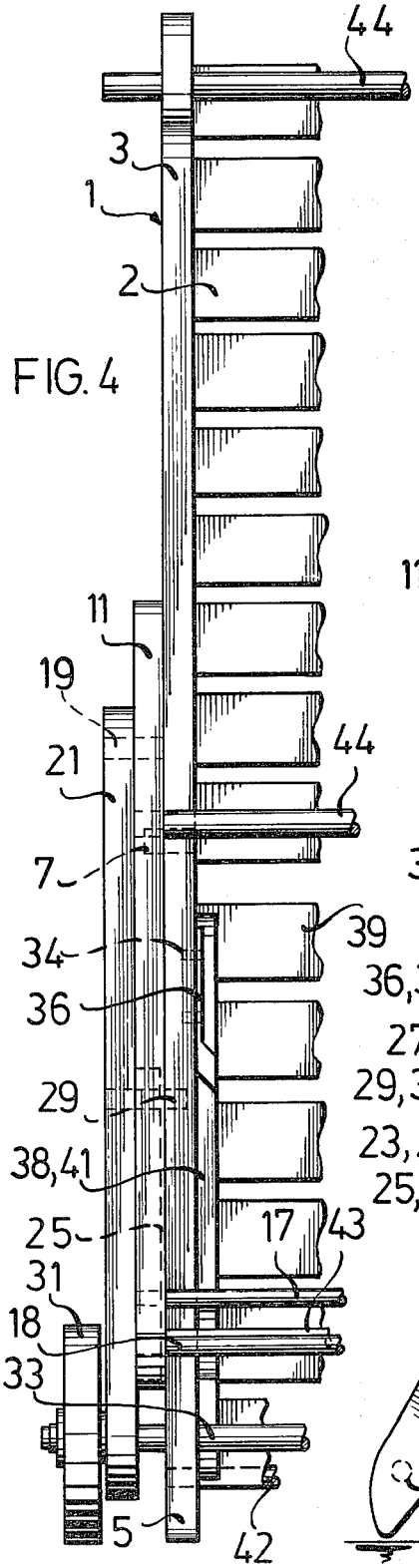
FIG. 4 shows the left-hand part of the collapsed lawn chair of the invention, seen from the rear.

According to FIG. 1, a lawn chair of the invention comprises a back 1 with side members 3, 4 held together by slats 2, followed by rigid feet 5, 6 somewhat at an angle in the forward direction. An outwardly projecting pivot journal 7, 8 is mounted to each side member 3, 4 at approximately equal spacings from the ends of the back and the feet, respectively; this pivot journal can engage into detents 9, 10, milled to half the depth into the inside of armrests 11, 12. Furthermore large and continuous bores 13–15 are arranged in the armrests 11, 12, and, besides a continuous bore 16, cross struts 17, 18 are provided at the wide rearward end; these cross struts firmly connect the armrests with each other. Somewhat remote from the narrower front end of the armrests 11, 12, pivotable feet 21, 22 are articulated thereto at 19, 20, these feet, in turn, being freely rotatably joined at 23, 24 to the feet 5, 6. On the insides of feet 21 and 22, strong strips 25, 26 are fixedly mounted, exhibiting, in addition to detents 27, 28, at the ends respectively one inwardly projecting stop pin 29, 30; these pins can be brought into contact with the narrow edges of the feet 5, 6. The lower ends of the feet 21, 22 carry respectively one caster 31, 32 freely rotatably supported at the free ends of a fixed rod 33. Angled iron straps 36, 37 are attached at 34, 35 between the pivot journals 7, 8 and the points of articulation 23, 24 of the back 1 and the feet 5, 6; these straps guide the one end of a seat 38 with slats 39 and respectively one recess 40 in the frame members 41. Cross struts 42, 43 serve for bracing the foot pairs 5, 6 and 21, 22, respectively.

In the position of the individual parts of a lawn chair of the invention as seen from FIG. 1, the frame members 41 of the seat 38 rest on a crossbar 44, the ends of which lie in the detents 27 of strips 25 and 26. This crossbar could consist of a simple pipe section to retain the seat 38. However, since the crossbar 44 is also to be introduced into the holes 13–15 to obtain the various reclining possibilities, and the ends of this crossbar are not held by the insides of feet 21, 22, individual round bars 45 are inserted according to FIG. 2 at the ends of the crossbar 44, these round bars being urged outwardly by a weak spring 46 and being held in their final position by a headless screw 47 in the longitudinal slot 48 of the crossbar 44. A sleeve 49 is fixedly seated on the free ends of the round bar 45, this sleeve exhibiting, in addition to an annular flange 50, a protective sleeve 51 with flange 52, by which the ends of the crossbar 44 are covered toward the outside. A rubber cap 53 is pushed over the outer end of the sleeve 49, this rubber cap fitting with play into the holes 13–16 of the armrests 11, 12, as well as into a bore 54 at the upper end of the back 1. FIG. 2 shows clearly how, in the operating position of the crossbar 44, its flange 50 rests securely on the inside of the armrest 11, 12, and the rubber cap 53 occupies the bores 13–15 of the armrests 11, 12 with a minor amount of play. By inserting the fingers between the two flanges 50 and 52, it is possible at any time to detach the bar from its position by moving the hands towards each other.

Figure 3:
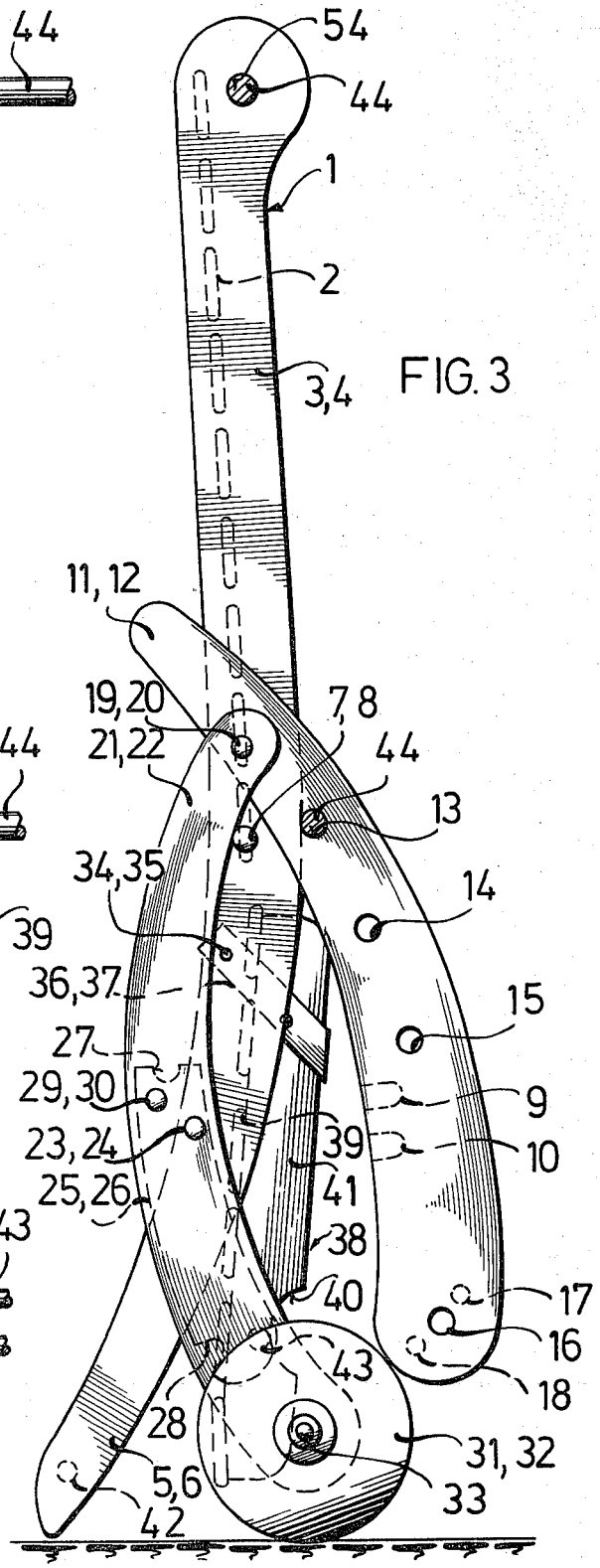
FIG. 3 shows the lawn chair of the invention in the collapsed condition provided for storage.

By grasping one of the cross struts 17, 18 and lifting same upwardly, the detents 9 release the pivot journals 7, 8 at the same time, and the aforementioned parts occupy the position according to FIG. 3 after lifting the crossbar 44 from the detents 27. If, now, the crossbar 44 is inserted in the bore 13, then the weight of the armrests 11, 12 urges the crossbar against the rear edge of the side members 3, 4 of the back 1, while simultaneously the stop pins 29, 30 prevent a further backward movement of the feet 21, 22. Since the seat collapses downwardly after removal of the crossbar 44 from the detents 27, 28, the slats 2 of the back 1 and the slats 39 of the seat 38 constitute almost a planar inclining surface, firmly hugged by a pad, not shown here, so that it is unnecessary to remove the pad before the chair is stored.

Figure 5:
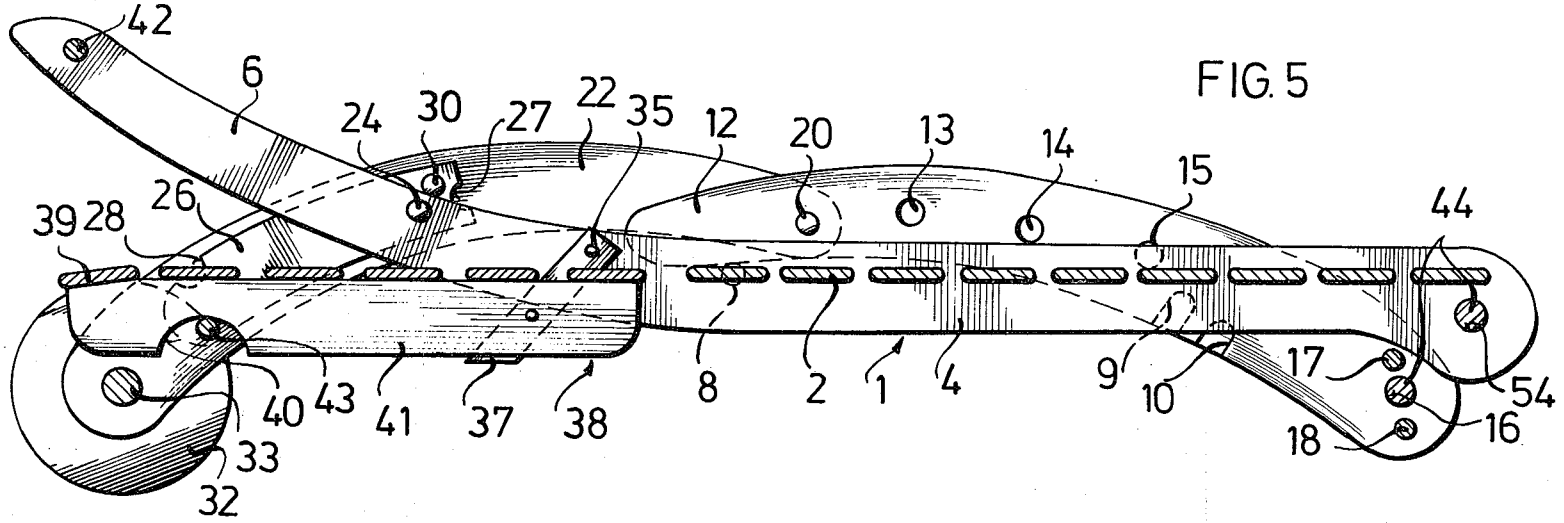
FIG. 5 shows the lawn chair of the invention with an entirely straight reclining surface when used as a chaise lounge.
Figure 6:
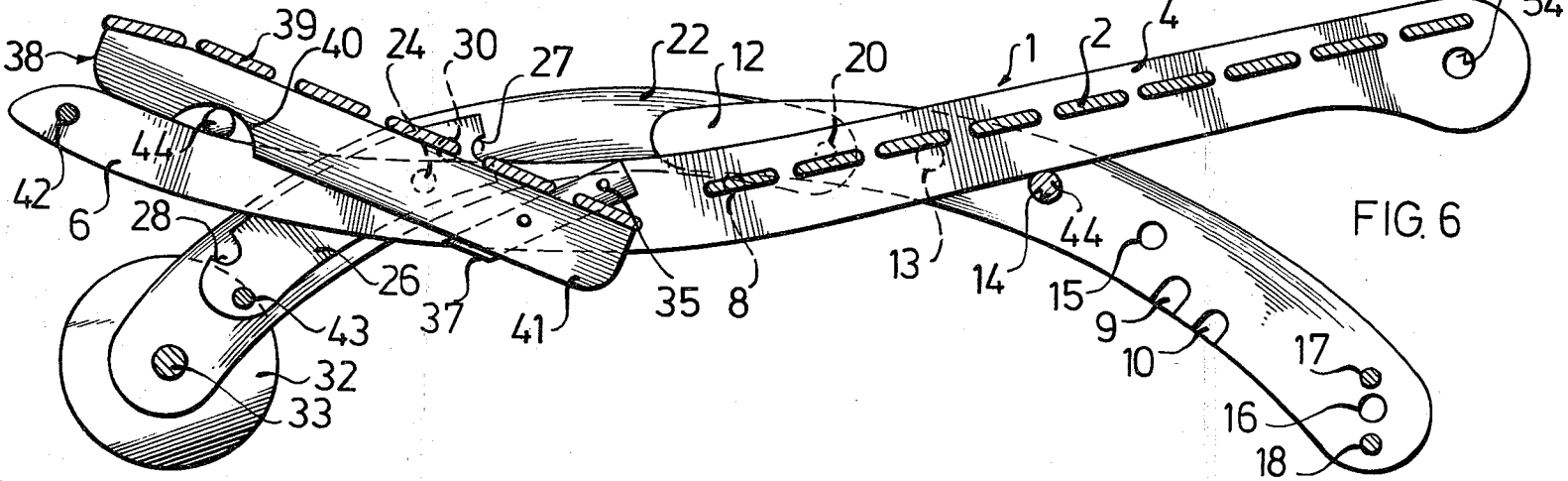
FIG. 6 shows the lawn chair with upwardly sloping head portion and foot portion of the reclining surfaces of FIG. 5.

If, in this storage position of the parts, the crossbar 44 is disengaged from the bores 13 and the armrest 11, 12 is pivoted about the points of articulation 19, 20 in the upward direction, and furthermore the back 1 is folded rearwardly and in the downward direction, then the parts of the chair occupy the position according to FIG. 5. The stop pins 29 and 30 are in firm contact with the front edges of the feet 5, 6. The front ends of the armrests 11, 12 are in contact with the pivot journals 7, 8 of the back 1, and the upper end of the back 1 rests on the cross strut 17. The cross strut 43 engages into the recess 40 of the frame member 41 of seat 38. The slats 39 of the seat 38 and the slats 2 of the back 1 form a horizontal plane of a recliner. It is furthermore possible to place the back including the seat surface into an inclined position by raising the head end of the back. Thereby the pivot journals 7, 8 of the back 1 urge the front part of the armrests 11, 12 in the upward direction and thus entrain simultaneously the points of articulation 19, 20 of the feet 21, 22 upwardly. If, now, a crossbar 44 is inserted in one of the bores 13–15, then the back remains in the lifted position as can be seen from FIG. 6. In FIG. 5, the seat 38 may be pivoted about pivot members 34, 35 and raised to a first position of inclination by insertion of a second crossbar 44 in the detents 28 where the crossbar is engaged in the recesses 40 of the frame members 41 of seat 38. As shown in FIG. 6, the seat 38 may be raised to a second and greater position of inclination by insertion of the second crossbar 44 across the angled feet 5, 6 of the side members 3, 4, where it is engaged by the recesses 40 of the frame members 41 of the seat 38 and urged against the front edges of the angled feet 5, 6.

In the position of the parts according to FIG. 5, none of the two crossbars is needed. Therefore, they are accommodated in the bores 16 of the armrests 11, 12 and in the bores 54 thereof at the upper end of the back 1, and are available at that location at any time.

The special footrest pertaining to the chair according to the invention exhibits one of the conventional types of construction. It is merely to be kept in mind that the variously adjustable heights of the footrest permit at all times an unhindered transition to the armchair.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

What I claim is:

1. An adjustable lawn chair having a separate footrest, as well as a back (1–4) adjoined by a supporting foot portion (5, 6) extending at a small angle thereto, a pivotable foot (21, 22) forming an adjustable cross with the supporting foot portion, and with an armrest (11, 12) articulated to the pivotable foot (21, 22), characterized by said back (1–4) including side members (3, 4), a pivot journal (7, 8) approximately at the center of the length of each respective side member and projecting to the insides thereof, a seat (38) having one end freely movably articulated (35) to said side members in proximity to the pivot journals (7, 8), said seat having side frame members (41), at least one recess (40) on the underside of each of said side frame members, a fixed strip (25, 26) on the inside of the pivotable foot (21, 22) equipped at the ends with recesses (27, 28), a crossbar (44) adapted to be removably received in said recesses (27, 28), an inwardly directed stop pin (29, 30) on said fixed strip (25, 26) adapted to move into contact with the front edge of said side members (3, 4), detents (9, 10) on said armrest (11, 12) milled into approximately one half the depth thereof for engaging said pivot journal (7, 8), and said armrest having at least one fixed cross strut (17, 18) at the free ends thereof.

2. An adjustable lawn chair according to claim 1 including at least two crossbars (44) that are removable, a bore (16) at the rear or free end of the armrest (11, 12), and a bore (54) at the upper end of the back (1), and said two crossbars (44) removably connected respectively in said bores (16, 54) during non-use.

3. An adjustable lawn chair according to claim 1, in which said armrests (11, 12) including in the longitudinal direction a series of large transverse bores (13–15), and said crossbar (44) adapted to be selectively inserted therein.

4. An adjustable lawn chair according to claim 3, the ends of the crossbar serve for the guidance of round bars (45) which latter are urged outwardly by a weak spring (46) until they abut against a stop (47), and that respectively one cap (53) is arranged, on the one hand, at the freely projecting ends of the bars, this cap fitting with a minor amount of play into the bore (13–15) of the back (1), and, on the other hand, two flanges (50, 52) are provided, between which the fingers can fit to be able to urge the caps, with one's hands, back into the crossbar (44) against the force of the spring (46).

* * * * *